US009609984B1

(12) United States Patent
Kelly

(10) Patent No.: US 9,609,984 B1
(45) Date of Patent: Apr. 4, 2017

(54) FOOT SCRUBBER

(71) Applicant: Jonathan C. Kelly, North Myrtle Beach, SC (US)

(72) Inventor: Jonathan C. Kelly, North Myrtle Beach, SC (US)

( * ) Notice: Subject to any disclaimer, the term of this patent is extended or adjusted under 35 U.S.C. 154(b) by 313 days.

(21) Appl. No.: 14/274,446

(22) Filed: May 9, 2014

(51) Int. Cl.

| | |
|---|---|
| ***A47K 7/04*** | (2006.01) |
| ***A47K 7/02*** | (2006.01) |
| *A47L 13/26* | (2006.01) |
| *A46B 13/04* | (2006.01) |

(52) U.S. Cl.
CPC ..... *A47K 7/04* (2013.01); *A47K 7/026* (2013.01); *A46B 13/04* (2013.01); *A47L 13/26* (2013.01)

(58) Field of Classification Search
CPC A47K 7/026; A47K 7/04; A47L 23/22; A47L 23/00; A47L 13/26; A47L 23/02; A61L 2/10; A61H 35/006; A46B 13/00; A46B 13/001; A46B 2200/306; A46B 15/0034; A46B 13/04; B08B 7/0057; B08B 3/10; B08B 1/002; B08B 1/04
USPC ..... 15/34, 104.92
See application file for complete search history.

(56) References Cited

U.S. PATENT DOCUMENTS

| | | | |
|---|---|---|---|
| 328,743 | A | 10/1885 | Allin |
| 516,541 | A | 3/1894 | Knoeppel |
| 620,674 | A | 3/1899 | Robinson |
| 852,955 | A | 5/1907 | Houghton |
| 970,673 | A | 9/1910 | Williams |
| 1,372,412 | A | 3/1921 | Finkhousen |
| 1,927,462 | A | 9/1933 | Marsh-Nunn |
| 3,359,572 | A | 12/1967 | Blackwell |

(Continued)

FOREIGN PATENT DOCUMENTS

| | | | |
|---|---|---|---|
| DE | 3833107 A1 * | 4/1990 | ..... A47L 23/06 |
| DE | 3926256 | 2/1991 | |

(Continued)

OTHER PUBLICATIONS

Buonanno, Manuela et al., "207-nm UV Light—A Promising Tool for Safe Low-Cost Reduction of Surgical Site Infections I: In Vitro Studies." PLOS | One, <http://www.plosone.org/article/info%3Adoi%2F10.1371%2Fjournal.pone.0076968>, Oct. 16, 2013.

(Continued)

*Primary Examiner* — Laura C Guidotti
(74) *Attorney, Agent, or Firm* — Hanrahan Law Firm, P.A.; Benjamin M. Hanrahan

(57) ABSTRACT

A foot scrubber and a method of scrubbing a foot are presented herein. The foot scrubber includes a housing, a brush assembly disposed within a scrubbing region of the housing, and a drive assembly disposed at least partially within a water-tight internal region of the housing and in a rotationally driving relation with the brush assembly. Further structural advantages of the foot scrubber include at least one ultraviolet (UV) light assembly disposed in an illuminating and disinfecting relation with the scrubbing region of the housing and the user's foot, a fluid dispensing assembly positioned to dispense a fluid into the scrubbing region for contact with the foot, and an activation assembly for automatically activating the drive assembly, the UV light assembly and the fluid dispensing assembly according to a predetermined cycle.

1 Claim, 11 Drawing Sheets

(56) References Cited

U.S. PATENT DOCUMENTS

| | | | | |
|---|---|---|---|---|
| 3,609,791 | A | 10/1971 | Siegel et al. | |
| 3,918,117 | A * | 11/1975 | Plante | A47K 7/04 15/88.3 |
| 3,973,286 | A | 8/1976 | Logan | |
| 4,130,908 | A | 12/1978 | Alcamo | |
| D283,847 | S | 5/1986 | Miller | |
| D288,503 | S | 3/1987 | Miller | |
| 4,918,779 | A | 4/1990 | Burns | |
| D343,476 | S | 1/1994 | Tomsick | |
| 5,321,867 | A | 6/1994 | Probst | |
| 5,384,933 | A * | 1/1995 | Wang | A46B 13/02 15/246.3 |
| 5,729,858 | A | 3/1998 | Riffel | |
| 5,978,996 | A | 11/1999 | Ullman | |
| 6,253,407 | B1 | 7/2001 | Bjelkevig | |
| 6,309,366 | B1 | 10/2001 | Maxwell | |
| 6,405,390 | B2 | 6/2002 | Kuen | |
| 6,438,768 | B1 | 8/2002 | Yen | |
| 6,505,358 | B2 | 1/2003 | Ferber et al. | |
| 6,575,171 | B1 * | 6/2003 | Jacquin | A45D 29/007 132/73.6 |
| 6,668,842 | B1 | 12/2003 | Wilke et al. | |
| 6,740,052 | B1 | 5/2004 | Regner | |
| 6,790,188 | B2 | 9/2004 | Chen | |
| 7,712,474 | B2 | 5/2010 | Dixon | |
| D620,095 | S | 7/2010 | Ullman et al. | |
| 7,877,826 | B2 | 2/2011 | Franklin | |
| 7,960,706 | B2 | 6/2011 | Ullman | |
| 7,967,521 | B2 | 6/2011 | Schiavo | |
| 8,296,874 | B2 | 10/2012 | Galati, Jr. et al. | |
| 8,466,433 | B2 | 6/2013 | Ullman | |
| 8,545,516 | B1 | 10/2013 | Winnett et al. | |
| 8,555,430 | B2 | 10/2013 | Nicas | |
| 8,656,546 | B2 | 2/2014 | Wang | |
| 8,763,188 | B2 | 7/2014 | Dombro | |
| 2004/0254511 | A1 | 12/2004 | Brborich | |
| 2005/0211270 | A1 | 9/2005 | Wheelwright | |
| 2007/0143918 | A1 | 6/2007 | Cafaro et al. | |
| 2010/0193709 | A1 * | 8/2010 | Dalton | A61L 2/10 250/504 R |
| 2012/0186031 | A1 | 7/2012 | Dombro | |

FOREIGN PATENT DOCUMENTS

| | | | |
|---|---|---|---|
| GB | 2469422 | A | 10/2010 |
| GB | 2448654 | B | 12/2010 |
| WO | WO2009086053 | | 7/2009 |

OTHER PUBLICATIONS

SteriPEN | "Proven Technology," <http://www.steripen.com/ultra-violet-light/proven-technology/>, 2014.

SimpleHuman | "The Germs Stop Here," The Efficient Gift Guide, <http://www.simplehuman.com/pumps>. printed on Dec. 17, 2014.

SteriShoe | "Clinically Proven to Kill Germs in Shoes that Cause Athlete's Foot, Shoe Odor, & Toenail Fungus," <http://www.sterishoe.com/why-sterishoe/>, printed Dec. 17, 2014.

Wikipedia, "Ultraviolet Germicidal Irradiation," <http://en.wikipedia.org/wiki/Ultraviolet_germicidal_irradiation>, printed on Dec. 17, 2014, last modified on Dec. 2, 2014.

Java Korea, <http://javakorea.net/00_main/main.php>, printed on Dec. 17, 2014.

Contech, WaterDog Automatic Outdoor Pet Drinking Fountain, <http://www.amazon.com/Contech-300000408-Automatic-Discontinued-Manufacturer/dp/B0001ABC6U/ref=cm_cr_pr_product_top/178-2220286-4997752>, printed on Dec. 17, 2014.

* cited by examiner

FOOT SCRUBBER

FIELD OF THE INVENTION

The present invention is generally directed to a hands-free automatic foot scrubber which can be used in wet or dry environments to clean and, in some embodiments, sanitize and/or disinfect the user's foot. For instance, certain embodiments include at least one rotational brush, a drive assembly, one or more ultraviolet (UV) or disinfecting lights, a fluid dispensing unit and a motion sensor.

BACKGROUND OF THE INVENTION

Maintaining clean feet is oftentimes an overlooked or under-performed step in the everyday routine of individuals. Failure to properly maintain the cleanliness or grooming of feet can lead to growth of fungal or bacteria conditions including but certainly not limited to athlete's foot and other irritations. These conditions can lead to dry skin, irritation, itchiness, and peeling in mild cases, and infections or growths in more serious cases.

In order to prevent fungal, bacterial and other conditions of the foot, it is imperative to properly maintain the cleanliness of the foot via regular scrubbing and cleaning. However, it is often difficult for some to regularly scrub and clean his or her feet in an effective manner in order to avoid fungal and bacterial conditions.

Accordingly, there is thus a need in the art for an effective hands-free, easy-to-use and automatic foot scrubber for use in and/or out of the shower, as desired. The proposed foot scrubber would automatically activate (or turn on) upon detection of motion by the user, and automatically cycle through a number of different effective cleansing stages in order to effectively clean and scrub the user's foot.

For example, the proposed foot scrubber may include a rotational brush assembly driven by an internal drive assembly for automatically rotating and scrubbing the bottom of the user's foot when placed in contact therewith. Additional features may include one or more disinfecting UV lights which can shine on the user's foot during use and which would effectively destroy certain fungi and bacteria on the surface and below the surface of the user's skin. A disinfectant fluid spray or dispensing assembly could also spray or otherwise dispense soap, foam, gel or other disinfecting fluid onto the user's foot or the brush assembly to further assist in the cleaning process and foot scrubbing.

SUMMARY OF THE INVENTION

The present invention is generally directed to a foot scrubber and a method of scrubbing a foot using the foot scrubber. For instance, the foot scrubber, as disclosed in accordance with at least one embodiment of the present invention is structured for hands-free automatic activation and deactivation via one or more motion sensors and a control assembly. Particularly, upon disposition of a user's foot within a scrubbing region of the foot scrubber, motion of the foot is detected and a cycle of scrubbing is automatically activated. The foot scrubber may be used in wet environments, including but not limited to a shower, or in dry environments or outside of the shower, as desired.

For instance, the foot scrubber of at least one embodiment of the present invention, includes a housing structured to define an external scrubbing region and a substantially water-tight internal region. A brush assembly is disposed within the scrubbing region and includes at least one, and in some embodiments a plurality of rotational brushes for scrubbing the user's foot. A drive assembly is disposed at least partially within the substantially water-tight internal region of the housing and in a driving relation with the brush assembly. Particularly, the drive assembly, which in certain exemplary embodiments comprises a plurality of aligned pulleys and belts, is structured to rotationally drive the brush assembly about an axis facilitating a scrubbing action on the bottom portion of a user's foot.

Furthermore, the foot scrubber of at least one embodiment includes a UV light assembly disposed in an illuminating relation with the scrubbing region of said housing and configured to shine UV light on the user's foot during a cycle, or otherwise during cleaning of the user's foot via the foot scrubber. The UV light assembly may include UV lamps, bulbs, LEDs, etc., and in certain embodiments is structured to operate at short wavelengths for facilitating germicidal action, other otherwise for destroying microorganisms on the surface of the user's foot, below the surface of the skin, and in some embodiments, though callouses or thick skin portions.

Moreover, other structural features of the present invention include a fluid dispensing assembly connected to the housing and positioned to dispense a fluid into the scrubbing region for contact with the foot, either directly or via the brush assembly. For example, the fluid may include water, soap, gel, foam, or other fluids, including disinfecting or antibacterial liquid.

Furthermore, certain embodiments are structured for cleaning or scrubbing of a single foot during a single cycle. For example, a user would first position one foot into the scrubbing region for a cycle, and then switch feet for a second cycle.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1:
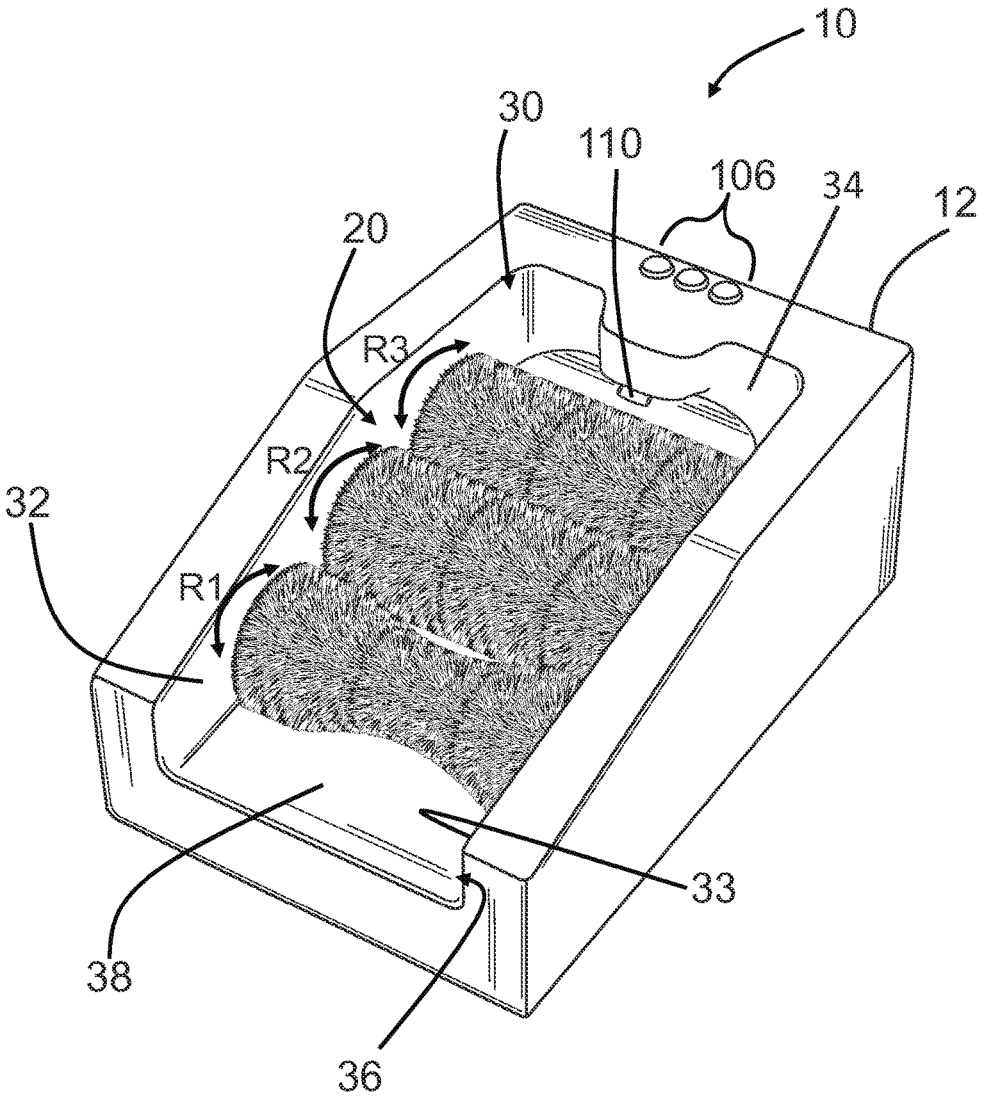
FIG. 1 is a perspective view of at least one embodiment of the foot scrubber as disclosed in accordance with at least one embodiment of the present invention.
Figure 2:
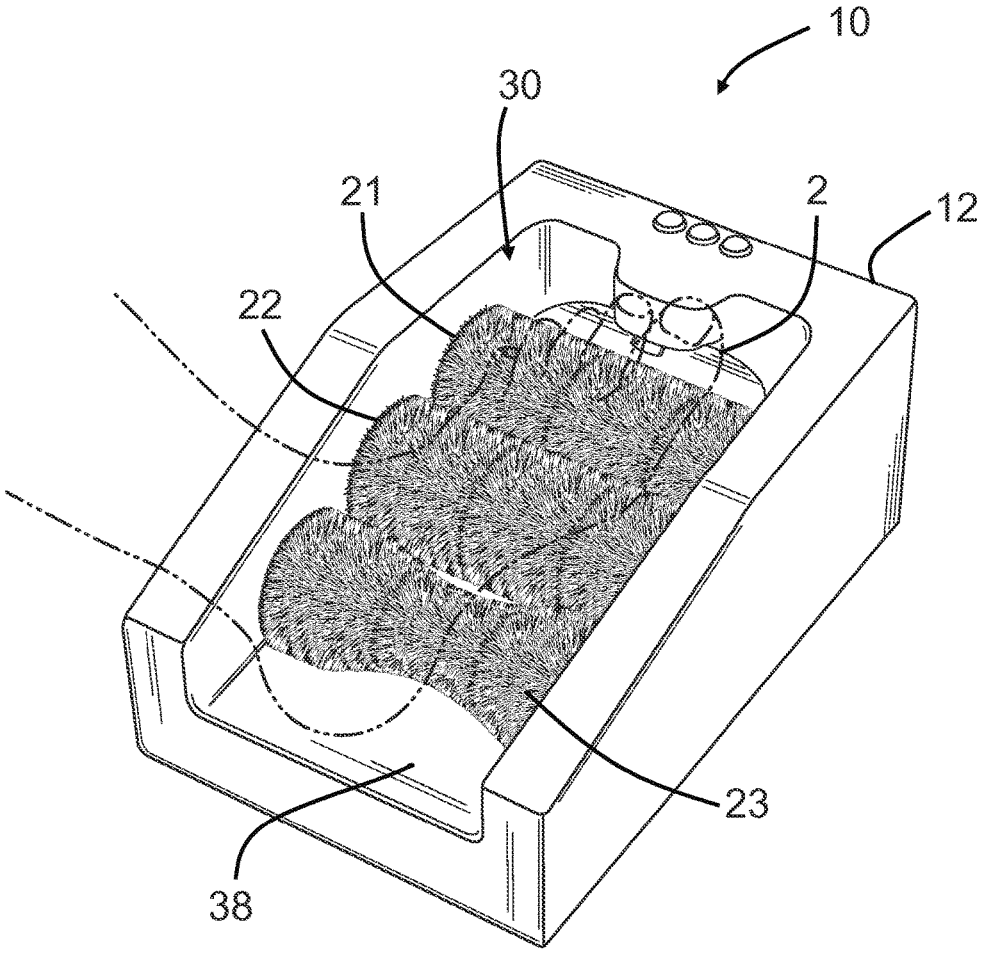
FIG. 2 is another perspective view of the embodiment illustrated in FIG. 1 with an illustration of a user's foot in dashed lines.

As shown in the accompanying drawings, and with particular reference to FIGS. 1 and 2, the present invention is directed to a foot scrubber, generally referenced as 10, configured to scrub, wash, and/or clean a user's foot, illustrated in dashed lines in FIG. 2, and generally represented as 2. It should be noted that certain embodiments of the present invention may be used in wet environments, including but not limited to a shower, and may thus be constructed to withstand and operate within the wet environment. However, the foot scrubber 10 disclosed in accordance with certain embodiments herein may be used in dry environments or outside of the shower, if so desired.

Still referring to FIGS. 1 and 2, the foot scrubber 10 of the present invention includes a housing 12 and a brush assembly 20 rotationally disposed relative to the housing. It should be noted that the housing 12 comprises an internal region 15 which is structured and configured to retain a drive assembly (disclosed herein) and/or other mechanisms structured to facilitate the practice of the present invention in the intended manner. As such, the housing 12 may be substantially water-tight, particularly in the embodiments configured for use in a shower or other wet environments, in a manner such that the internal region 15 and/or the components disposed therein remain substantially or completely dry in order to remain operative. The housing 12 may further be constructed of a generally rigid, water-resistant material such as plastic, ceramic, etc., or other material(s) capable of facilitating implementation of the present invention ion the intended manner. Accordingly, certain embodiments may also include a securing assembly 18 disposed on a bottom portion of the housing 12 for securing the housing 12 to a support surface, such as the floor of a shower or bath tub, for example. As such, the securing assembly 18 may include one or more suction cups or other like devices.

Furthermore, the housing 12 of at least one embodiment is configured to include a scrubbing region 30 generally defined as an area of the housing 12 which includes the brush assembly 20 and wherein a user may position his or her foot 2 for cleaning or scrubbing. In certain embodiments, the scrubbing region 30 may be defined by oppositely disposed side walls 32, 33, a rear wall 34, an at least partially open front portion 36, and a bottom surface 38. In at least one embodiment, the bottom surface 38 is structured or otherwise configured to include an at least partially sloped or angled configuration with a downward decline toward the at least partially open front portion. This allows any water or fluid to easily flow down the sloped bottom surface 38 and out through the at least partially open front portion 36, particularly in a wet environment such as the shower. In certain embodiments, the sloped configuration of the bottom surface 38 includes a substantially constant angle or decline from the rear wall 34 to the front portion 36. It should be noted, however, that the surface need not be a constant decline and instead may include various waves, angles, dips, etc. along the surface 38. Furthermore, other embodiments may include drain holes or drain openings (not shown) to facilitate removal of water or other fluid from within the scrubbing region 30.

The brush assembly 20 of at least one embodiment includes one or more brushes 21, 22, 23 configured to clean or scrub the user's foot upon contact therewith. For instance, the brushes 21, 22, 23 include a plurality of bristles or other scrubbing members, which in some cases are configured radially about an elongated axle, although other configurations are contemplated. The bristles or scrubbing members may include virtually any material such as stiff hair, feathers, or synthetic materials such as nylon, plastic, rubber, etc.

Moreover. The brush assembly 20 may include a plurality of adjacently disposed elongated brushes 21, 22, 23 that are each configured to rotate relative to the housing 12, for example, within the scrubbing region 30, about a longitudinal axis defined by the corresponding axles. As an example, FIG. 1 illustrates rotational arrows R1, R2 and R3 showing the rotational movement of the brushes towards and/or away from the front portion 36. In certain embodiments, as illustrated the adjacently disposed, elongated brushes 21, 22, 23 are disposed to span across the scrubbing region 30 between oppositely disposed side walls 32, 33.

Moreover, referring again to FIG. 2, at least one of the brushes 23 comprises a contoured configuration in that the inner portion of the elongated brush 23 comprises a thinner circumference than the outer portions, as illustrated. This provides a comfortable fit of the brush 23 within the curved bottom portion of the user's foot 2, as shown.

Figure 3:
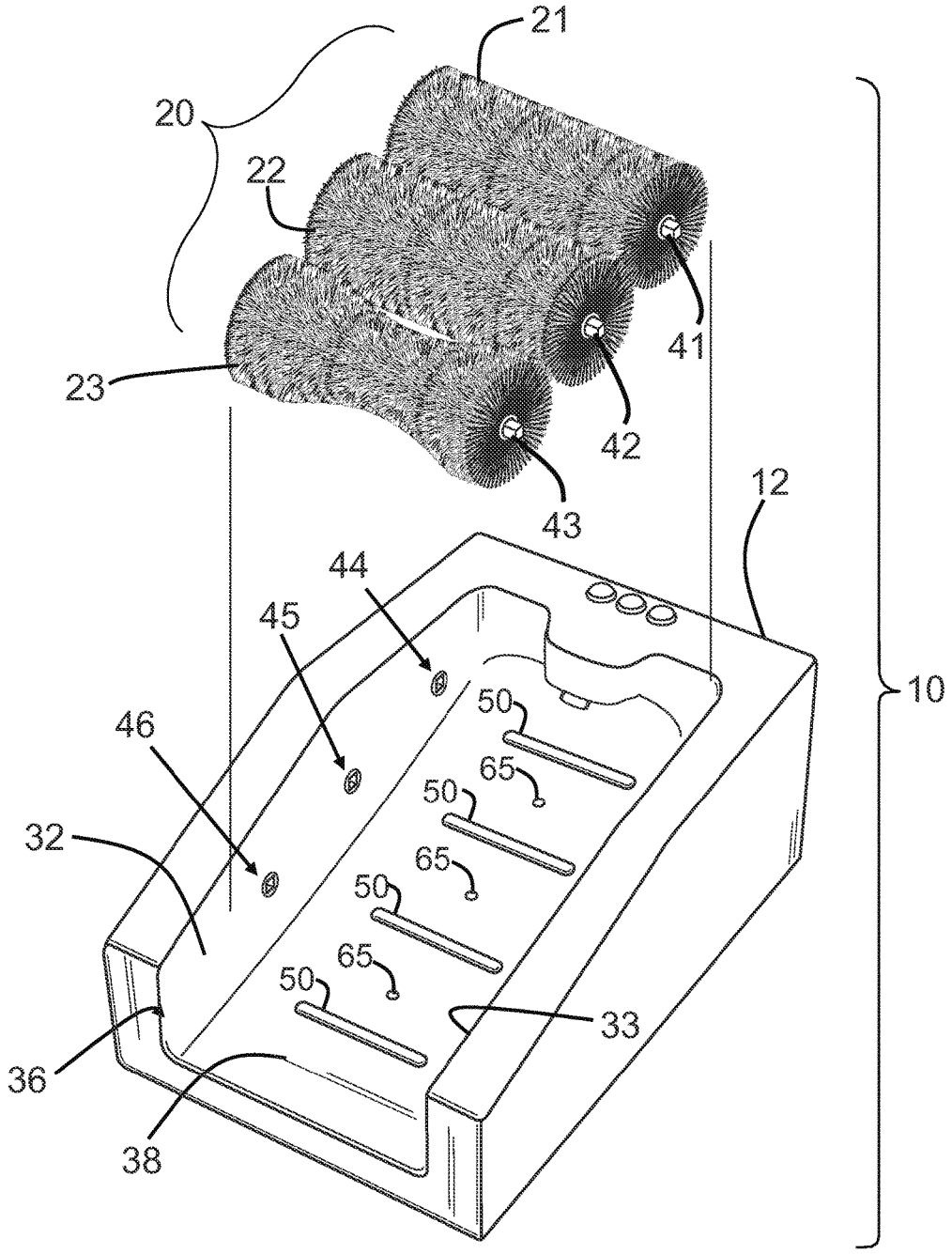
FIG. 3 is a partially exploded view of at least one embodiment of the foot scrubber of the present invention.

Furthermore, in at least one embodiment, the brush assembly 20, and in particular, the one or more brushes 21, 22, 23 thereof, may be removably disposed relative to the housing 12 for easy replacement, removal or cleaning. For instance, each of the brushes 21, 22, 23 may include oppositely disposed connection ends 41, 42, 43 which are removably engaged with cooperatively structured and rotationally driven drive ends 44, 45, 46. As illustrated in FIG. 3, the drive ends 44, 45, 46 are positioned within the scrubbing region 30 and on the oppositely disposed side walls 32, 33 thereof (although the drive ends on side wall 33 are hidden from view, they are positioned directly opposite the drive ends 44, 45, 46 on side wall 32 in order to allow the brushes 21, 22, 23 to span across the scrubbing region 30.) Furthermore, while the embodiment illustrated shows drive ends 44, 45, 46 and connection ends 41, 42, 43 having cooperatively structured square-shaped configurations, it should be noted that virtually any gripping or engaging configuration can be implemented allowing the drive ends 44, 45, 46 to grip and engage the connection ends 41, 42, 43. Thus, when the drive ends 44, 45, 46 rotate relative to the housing 12 via a driving force provided by the drive assembly, the connected brushes 21, 22, 23 rotate therewith.

Furthermore, it should be noted that the one or more brushes 21, 22, 23 may be easily removed and/or replaced, as desired, for example, by "snapping" in and out, or manually engaging/disengaging the connection ends 41, 42, 43 from the drive ends 44, 45, 46. Certain embodiments of the present invention further include at least partially flexible, bendable and/or resilient brushes or axles facilitating the removable engagement between the brushes and drive ends. For example, the one or more brushes 21, 22, 23 may include an at least partially flexible or bendable axle allowing the brush(es) to be temporarily flexed or bent. This allows the brush(es) to be easily installed or mounted into the housing 12 and removed from the housing 12, as desired. It should also be noted that the flexible configuration of the brush(es) 21, 22, 23 and/or the axles thereof provide an added safety feature in that if a user presses down too hard (e.g., by stepping on the installed brush and exerting excessive weight or stress thereon), the brush(es) may disengage from the drive ends 44, 45, 46. Furthermore, instead of a user's foot inadvertently getting stuck under or between the brush(es) 21, 22, 23, the flexible nature of the brush(es) 21, 22, 23 may disengage the brush(es) 21, 22, 23 from the drive ends 44, 45, 46 rather than damaging the foot scrubber 10 or injuring the user.

Still referring to FIG. 3, at least one embodiment of the present invention further includes at least one ultraviolet ("UV") light assembly 50 which is disposed in an illuminating relation with the scrubbing region 30 of the housing 12 and structured to emit UV light for contact with the foot. For example, the UV light assembly 50 of at least one embodiment may include one or more UV lamps, bulbs, light emitting diodes (LEDs), etc. structured to emit germicidal UV light in a narrow spectrum or short wavelength which is designed to attack certain bacteria, fungi, and other microorganisms. It should be noted that the UV light emitted by the UV light assembly 50 of the present invention may include a wavelength of between 185 nanometers (nm) and 270 nanometers (nm), although other wavelengths above or below that range and sufficient to attack, kill or destroy certain bacteria, fungi, etc. under the user's skin and/or callouses can be implemented.

As shown in the embodiment of FIG. 3, the UV light assembly 50 may include a plurality of lamps, bulbs or LEDs disposed within the scrubbing region 30 of the housing 12 in a manner such that the UV light emitted therefrom will contact the user's foot when the using the foot scrubber 10 of the present invention. For example, the UV lights 50 may be positioned in a spaced relation along the bottom surface 38 of the scrubbing region 30 offset from the axles or axes of the brush assembly 20, allowing the light to contact the user's foot without being obstructed from the brush assembly 20. Other locations for the UV light assembly 50, including, but not limited to along the side wall(s) 32, 33 and rear wall 34, may be implemented. It should also be noted that, although a generally thin, elongated configuration for the UV light assemblies 50 is illustrated in FIG. 3, other shapes, sizes and configurations are contemplated, such as round, rectangular, etc., and may be implemented within the full spirit and scope of the present invention.

Figure 4:
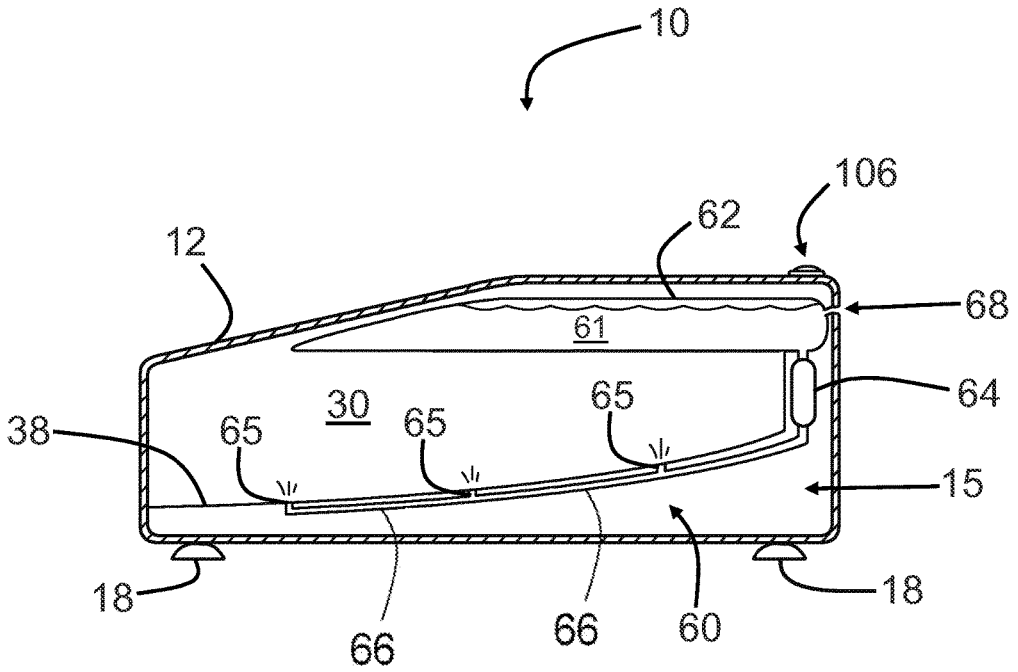
FIG. 4 is a partial internal side view of the foot scrubber as disclosed in accordance with at least one embodiment herein.

Referring now to the partial internal view of FIG. 4, at least one embodiment of the present invention includes a fluid dispensing assembly 60 structured to dispense a fluid 61 into the scrubbing region 30 and into either a direct or indirect contact with the user's foot. For example, the fluid 61 may be released into the scrubbing region 30 and directly engage, contact or at least partially coat the user's foot. Other embodiments may dispense the fluid 61 onto the brush assembly 20 and then engage, contact or coat the user's foot by virtue of the user's foot being in contact with the brush assembly 20.

Particularly, the fluid dispensing assembly 60, of at least one embodiment includes a reservoir 62, a pump 64 and one or more nozzles 65. The fluid 61 is initially disposed or retained within the reservoir 62 for eventual dispensing into the scrubbing region 30 by way of the pump 64 and one or more nozzles 65. For instance, as illustrated in FIG. 4, the nozzles 65 are fluidicially connected to the pump 64 via one or more conduits 66, and the pump 64 is, in turn, fluidically connected to the reservoir 62. Accordingly, when the pump 64 is activated or energized, fluid is drawn out of the reservoir 61, pumped through the conduit(s) 66, and dispensed into the scrubbing region 30 via the one or more nozzles 65.

It should be understood that the fluid 61, as used herein, may include liquid, gel, foam, soap, or other flowing fluid capable of facilitating practice of the present invention in the intended manner. As an example, the fluid 61 may be water, disinfecting or antibacterial liquid, disinfecting or antibacterial soap, gel, etc. Other embodiments of the fluid 61 may include a liquid form, for example when the fluid 61 is disposed in the reservoir 62, although the fluid 61 may be transformed from liquid to a foam when dispensed though the one or more nozzles 65. Furthermore, the nozzle(s) 65 are structured to dispense the fluid 61 into the scrubbing region 30 and may include a spraying nozzle which can project the fluid outward and onto the brush assembly 20, foot 2, etc. Other embodiments of the nozzle(s) 65 may include a drip nozzle or other dispensing mechanism. It should also be noted that while the nozzle(s) 65 shown in FIG. 4 are disposed in a spaced relation along the bottom surface 38 of the scrubbing region 30, other locations are contemplated, including, but not limited to, along the side walls 32, 33, rear wall 34, etc.

Figure 5:
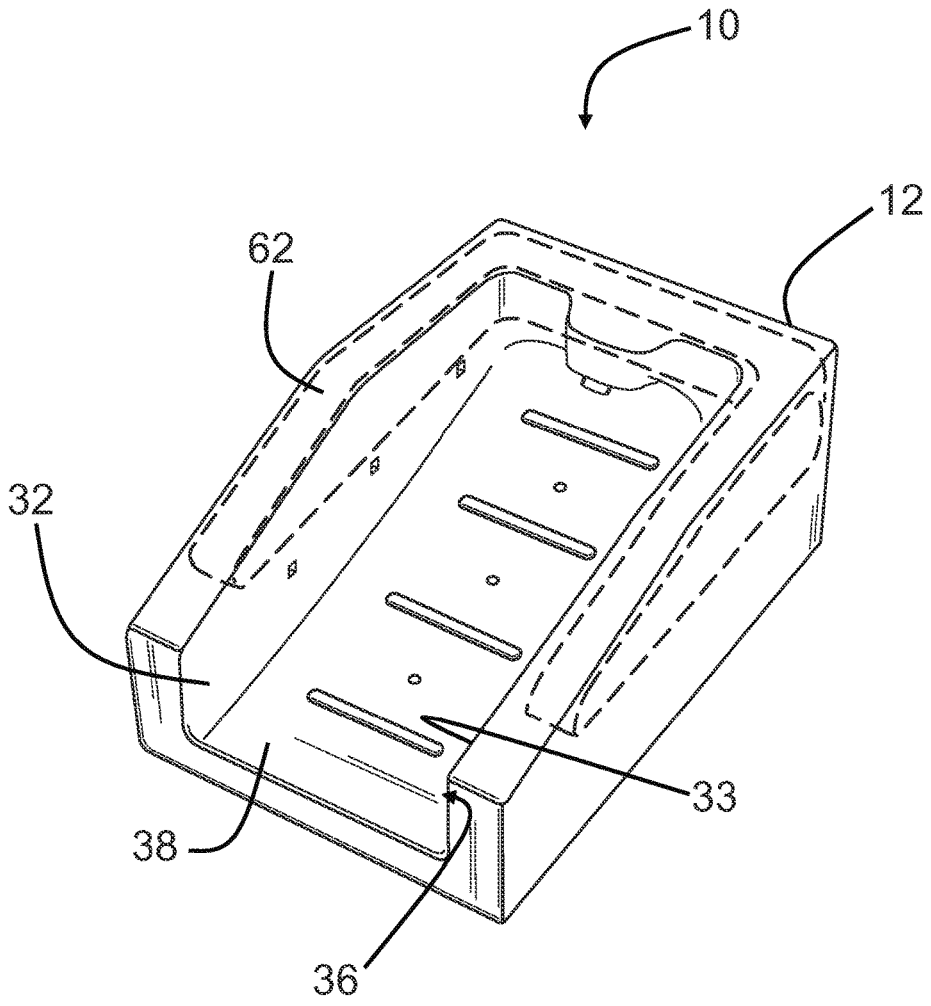
FIG. 5 is a perspective view of the housing of the foot scrubber of at least one embodiment illustrating the reservoir in dashed lines.
Figure 6:
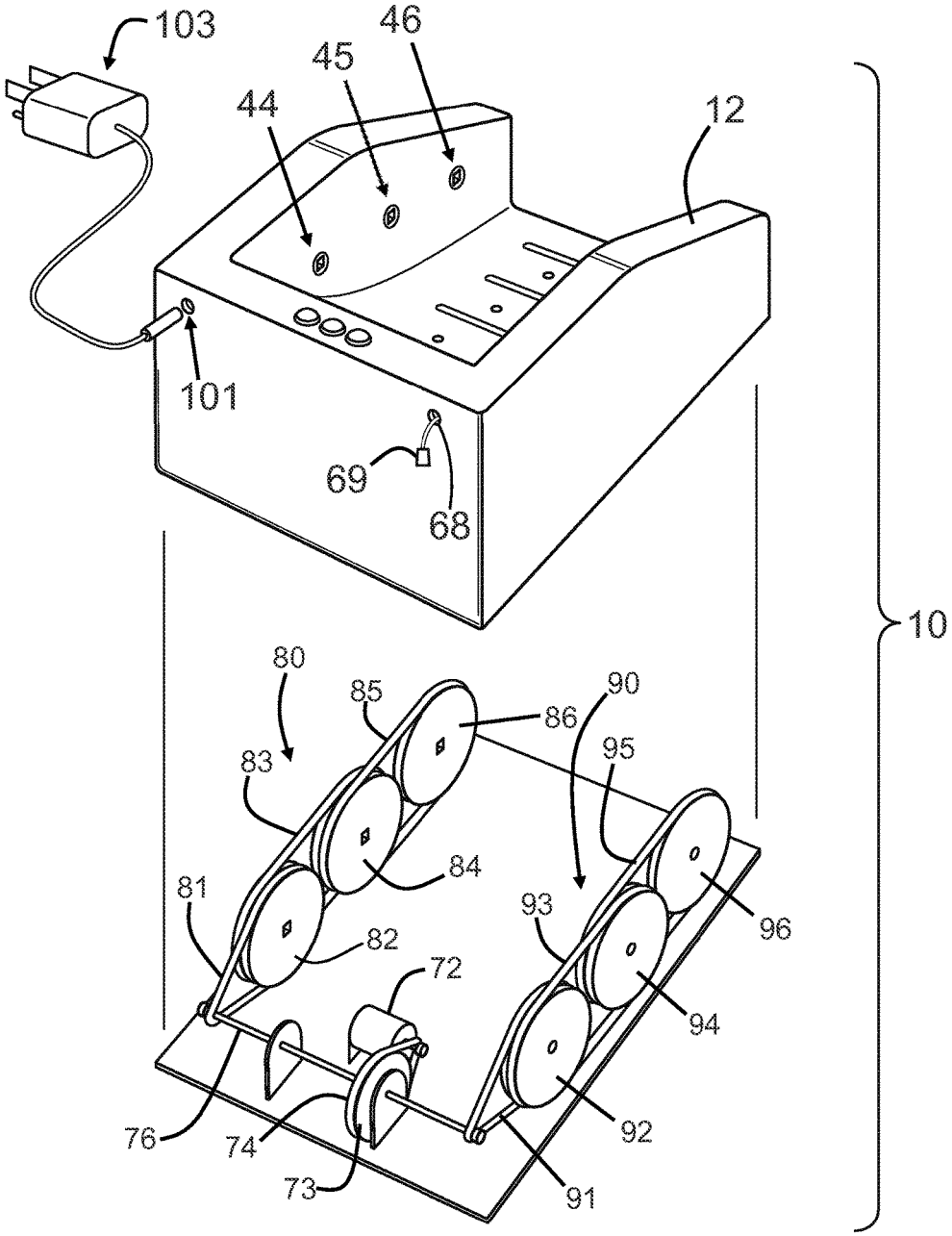
FIG. 6 is a partial exploded view of the housing and drive assembly as disclosed in accordance with at least one embodiment of the present invention.
Figure 7:
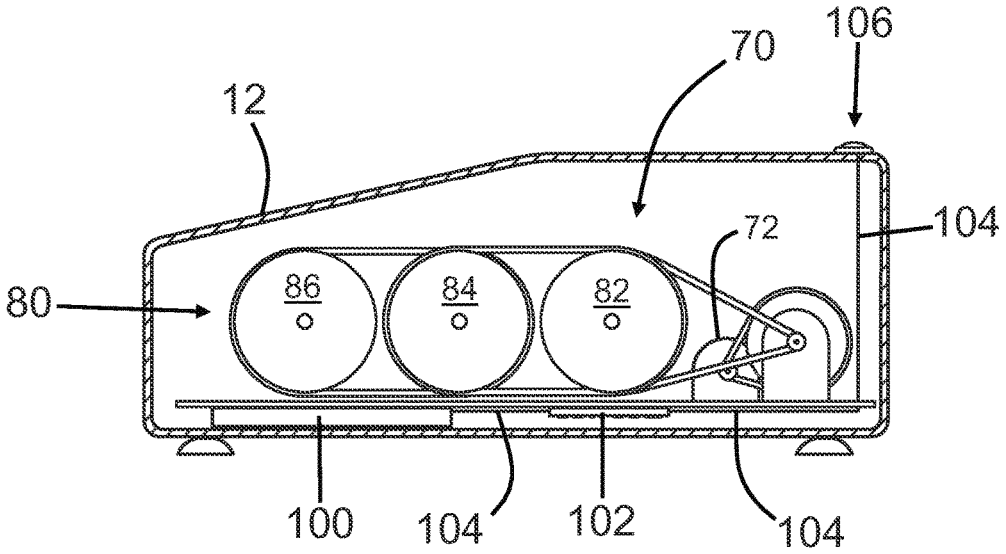
FIG. 7 is a partial internal side view of illustrating the drive assembly as disclosed in accordance with one exemplary embodiment of the present invention.
Figure 8:
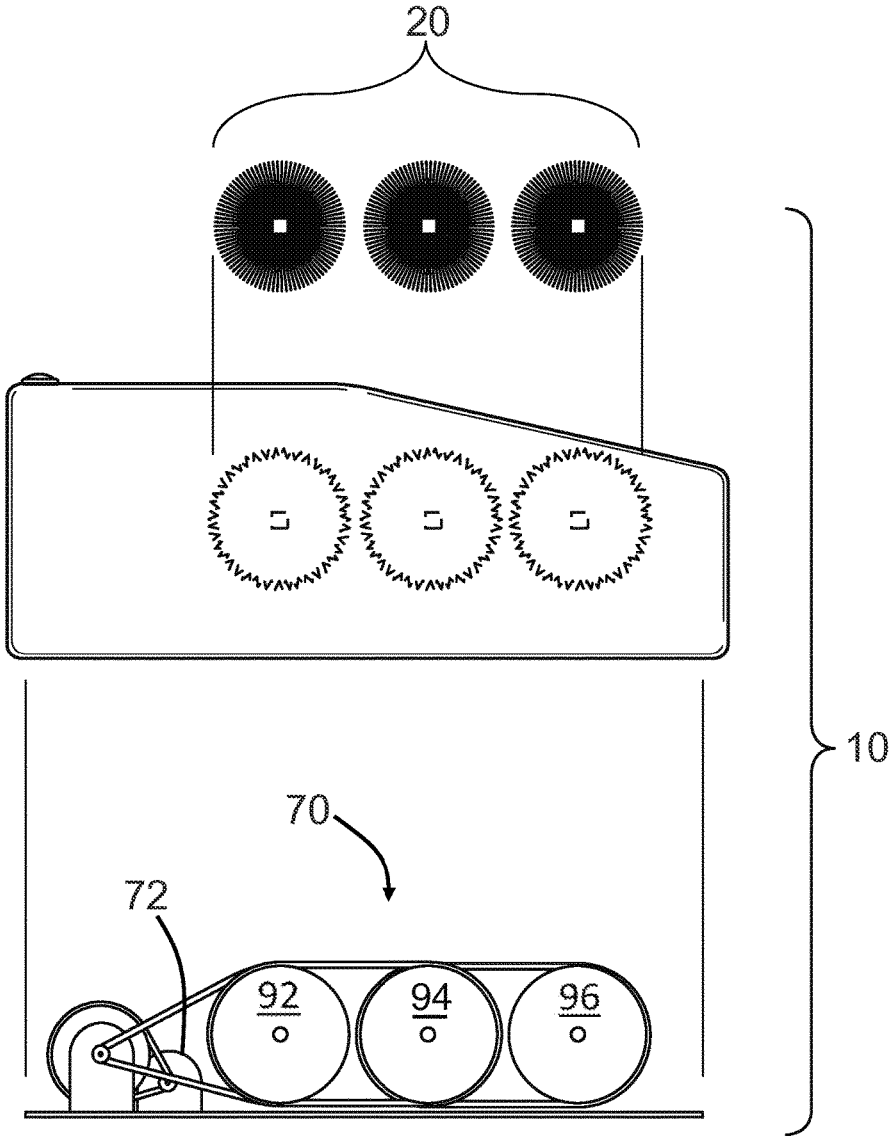
FIG. 8 is a side exploded view of the foot scrubber as disclosed in accordance with at least one embodiment of the present invention.

As shown in FIG. 5, the reservoir 62 may be disposed within the housing 12 around the upper portion thereof. For example, in the embodiment shown, the reservoir 62 spans in a "U" shape along the upper portion of the inside of the housing 12 around the side walls 32, 33 and rear wall 34 of the scrubbing region 30. Of course, other locations, sizes, dimensions, and shapes for the reservoir 62 are contemplated, and the embodiment shown is for non-limiting illustrative purposes only. It should also be noted that a fill hole 68 may be provided on the housing 12 and in a fluid relation with the reservoir 62 in a manner that allows the user to refill the reservoir 62 with any desired fluid 61. The fill hole 68 may be positioned on an upper rear corner of the housing 12, as shown in FIG. 6, although other locations are contemplated. A plug 69 or other closure mechanism is structured to close or seal the fill hole 68.

FIGS. 6 through 11 illustrate an exemplary drive assembly 70 disposed at least partially within the internal region 15 of the housing and in a driving relation with the brush assembly 20. For example, the drive assembly 70, when activated, is structured to rotationally drive the brush assembly 20, which, as described herein, are removably connected to drive ends 44, 45, 46.

Particularly, in at least one exemplary embodiment, the drive assembly 70 comprises an electric motor 72 which, when activated, drivingly engages or otherwise powers pulley systems 80, 90 disposed within the housing 12 and on opposite sides thereof. The pulley systems 80, 90 engage the drive ends 44, 45, 46, which, in turn, rotationally drive the brush assembly 20. In the embodiment shown, the pulley systems 80, 90 include longitudinally or axially aligned pulley pairs (82, 92), (84, 94), (86, 96), wherein each of the pulley pairs (82, 92), (84, 94), (86, 96) correspond to, or otherwise drive, a common connected brush of the brush assembly 20.

Furthermore, as illustrated in FIG. 6, a first pulley pair (82, 92) of at least one embodiment is connected to or drivingly engaged with a drive axle 76 via a first belt 81, 91 or other drive connection. The belts 81, 91 fit within a first belt engagement structure or groove disposed around the periphery of the corresponding pulley 82, 92 and engage the drive axle 76, for example, within a groove or other connection.

The drive axle 76 is rotationally driven, either directly or indirectly, via the motor 72. For instance, in the embodiment shown, the motor 72 may be connected to drive pulley 73 via a drive belt 74, wherein the drive pulley 73 engages or is otherwise connected to the drive axle 76. Thus, when the motor 72 is activated, the drive belt 74 engages the drive pulley 73, which in turn, rotates the drive axle 76. The drive axle 76, therefore, rotates the first pulley pair (82, 92) via the interconnected first belts 81, 91. It should be noted that in certain embodiments, the motor 72 may be directly connected to the drive axle 76, for example, without using the drive pulley 73 or drive belt 74.

Turning back to the pulley systems 80, 90, the first pulley pair (82, 92) may be connected to a second or intermediate pulley pair (84, 94) via a second or intermediate belt 83, 93. In this manner, the pulleys in the first pulley pair (82, 92) may include two belt attachment structures, such as two adjacent grooves disposed around the circumference or periphery thereof in order to simultaneously engage the first belt 81 and the second or intermediate belt 83. Thus, rotation of the first pulley pair (82, 92) will cause the second or intermediate pulley pair (84, 94) to rotate via the belts 83, 93.

In the event the brush assembly 20 includes a third brush, as illustrated in the exemplary embodiment, a third pulley pair (86, 96) may be included within the pulley systems 80, 90. In this manner, the second or intermediate pulley pair (84, 94) may be interconnected with the third pulley pair (86, 96) via a third belt 85, 95. Thus, in the illustrated embodiment, the second or intermediate pulley pair (84, 94) may include a second belt attachment structured such as a second groove disposed around the periphery thereof to simultaneously engage the second belt 83 and the third belt 85, 95. In this manner, rotation of the second or intermediate pulley pair (84, 94) will cause the third pulley pair (86, 96) to rotate therewith via the third belt 85.

Additional pulley pairs, and brushes, may be implemented, as desired within the full spirit and scope of the present invention. It should be noted that the last pulley pair need only include a single belt engagement structure or groove disposed around the outer circumference as the last pulley pair need only engage with the previous, adjacent pulley pair.

Figure 9:
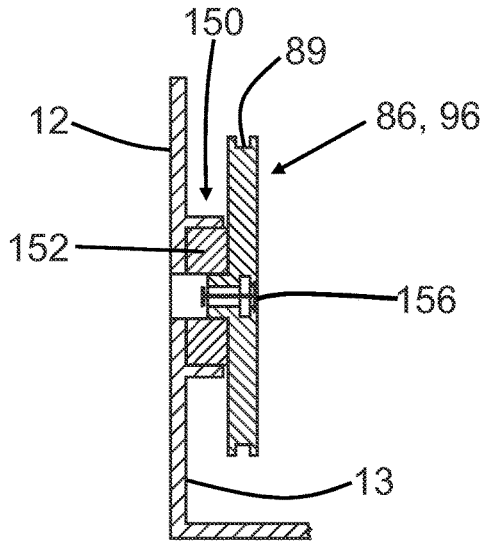
FIG. 9 is a side cut-away view of the pulley attachment assembly as disclosed in accordance with another embodiment of the present invention.
Figure 10:
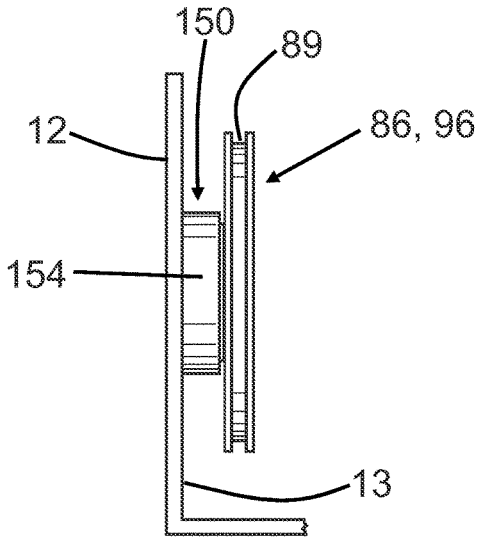
FIG. 10 is a side view of the pulley attachment assembly illustrated in the exemplary embodiment of FIG. 9.
Figure 11:
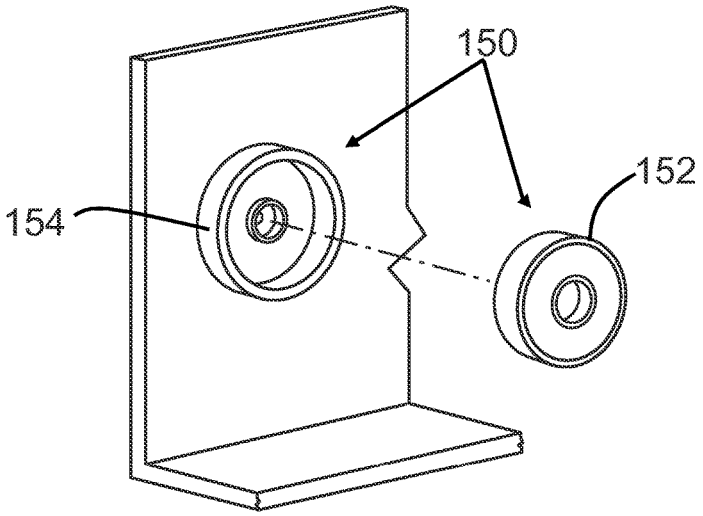
FIG. 11 is a partially exploded view of the pulley attachment assembly illustrated in the exemplary embodiment of FIGS. 9 and 10.

Referring now to FIGS. 9, 10 and 11, a pulley attachment assembly 150 of at least one exemplary embodiment is illustrated. Of particular note, the pulley 86, 96 illustrated in FIGS. 9, 10 and 11 illustrate a single belt attachment structure 89, such as a groove disposed around the periphery of the pulley for interconnection with a corresponding belt. However, other pulleys disclosed herein, as provide above, may include a plurality of belt attachment structures 89. Either way, the pulleys, whether including a single or multiple belt attachment structures 89, may be connected to the housing 12 via the exemplary pulley attachment assembly 150.

For instance, the pulley attachment assembly 150 of at least one embodiment may include a bearing 152 and a bearing housing 154. The bearing housing 154 may be connected to an internal surface 13 of the housing 12 or to an additional bearing support (not shown). Either way, the bearing housing 154 is structured to receive a bearing 152 therein to provide a rotational connection to the attached pulley. Particularly, the pulley may be connected to the bearing 152, such as via an internal pin 156 allowing the pulley to rotate with the bearing 152 relative to the housing 12 and/or bearing housing 154. In this manner, the pulley may be "suspended" within the housing and rotationally disposed via the motor 72, belts and pulley attachment assembly 150. Furthermore, other drive assemblies and/or pulley attachment assemblies which are structured to facilitate rotational movement of the brush assembly 20 in accordance with the various embodiments disclosed herein are contemplated within the full spirit and scope of the present invention and the illustrative example provided herein and in the drawings should be viewed as non-limiting.

Referring back to FIG. 7, other structural features of the present invention may include one or more batteries 100 and a control assembly or printed circuit board (PCB) 102. For instance, the foot scrubber 10 of the present invention may be powered via one or more conventional, replaceable batteries, although certain embodiments may be implemented with a rechargeable battery pack disposed within the housing 12. Particularly, the rechargeable battery or battery pack may be a lithium-ion or other type of battery connected to the control assembly 102 and/or motor 72 via electrical connections, generally referenced as 104 in FIG. 7. A charging port 101 may also be included for connecting an external cable to a power supply, such as a wall outlet. The cable will supply power to the battery 100 for recharging purposes, although the foot scrubber 10 may function while plugged in, particularly in dry environments. A water-tight plug (not shown), for example a rubber cover, may be provided to close the power or charging port 101 when the foot scrubber 10 is used in a wet environment, such as in the shower.

The control assembly or PCB 102 may include a processor, memory and/or other devices and structures capable of controlling and implementing certain aspects of the present invention, including, for example, the cycle, as will be described herein. Other features may include indicator lights 106, a power button or power switch (not shown), etc.

For instance, further embodiments of the present invention include an activation assembly, which may include a motion sensor 110 disposed in a detecting relation relative to the scrubbing region 30 for detecting movement and/or disposition of a user's foot within the scrubbing region 30. Particularly, the activation assembly or motion sensor 110, which active, is structured to identify or detect when the user has placed his or her foot within the scrubbing region 30 in order to facilitate hands-fee, automatic activation of a cycle. Specifically, in at least one embodiment, when the activation assembly detects that a user has placed his or her foot within the scrubbing region, the drive assembly 70, UV light assembly 50, and fluid dispensing assembly 60 may be activated for certain periods of time defining a cycle. More in particular, the motion sensor 110, upon detecting motion, may communicate a signal to the control assembly or PCB 104. The control assembly or PCB may then control activation and deactivation of certain components, such as the motion sensor 110, the drive assembly 70, UV light assembly 50 and fluid dispensing assembly 60. In at least one embodiment, a single detection of motion by the motion sensor 110 will trigger a single cycle of rotation of the brush assembly 20 via the drive assembly 70, spraying or dispensing of fluid via the fluid dispensing assembly 60, and illumination of UV light via the UV light assembly 50.

Figure 12:
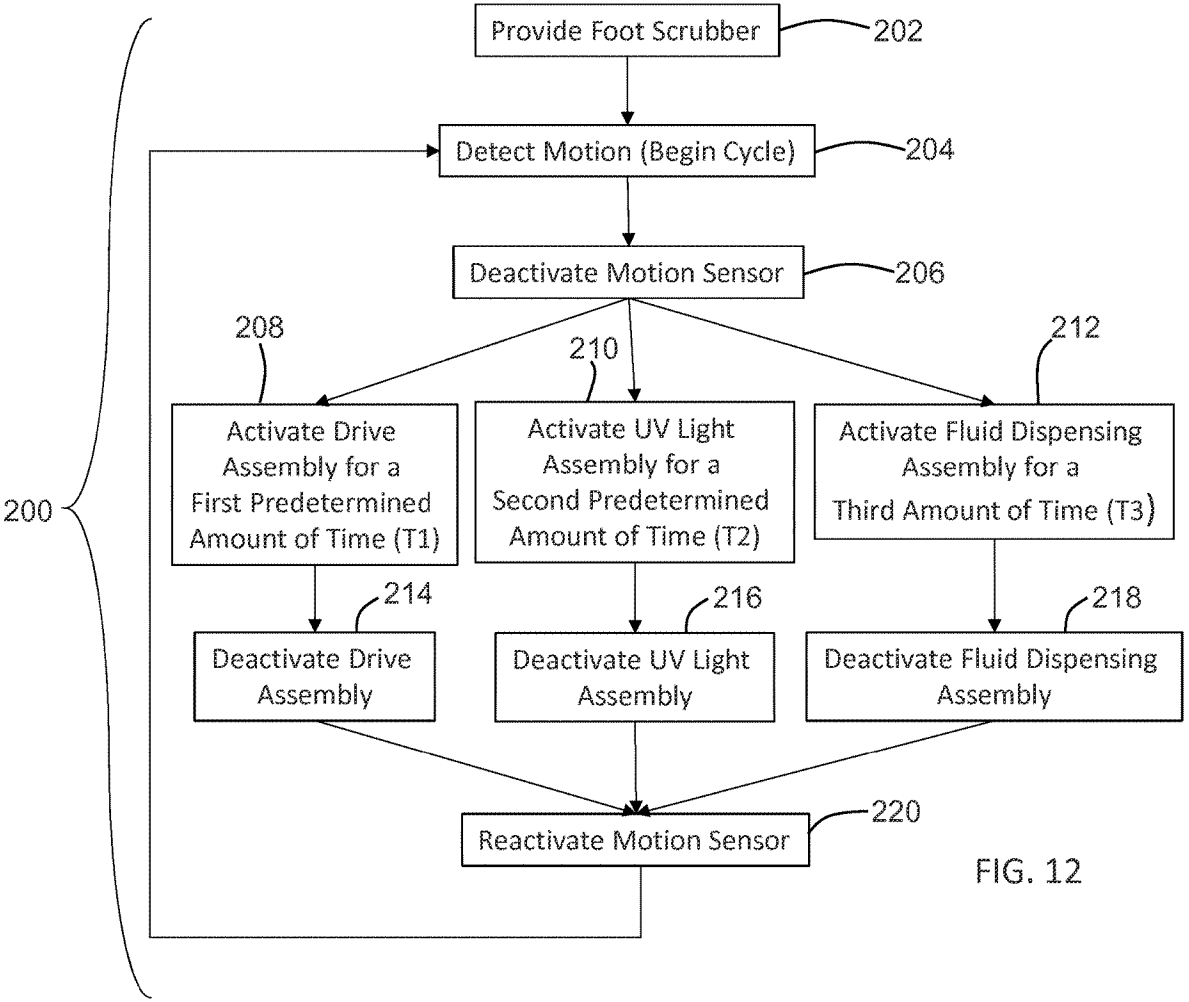
FIG. 12 is a high-level flow chart illustrating the method of scrubbing a foot as disclosed in accordance with at least one embodiment of the present invention.

For example, FIG. 12 illustrates an exemplary method 200 for scrubbing foot in accordance with at least one embodiment of the present invention. Particularly, the method 200 includes providing a foot scrubber 202 as described in accordance with at least one embodiment herein. Furthermore, the method 200 includes detecting motion from a user's foot within the scrubbing region, generally referenced as 204. Specifically, when a user places his or her foot within the scrubbing region 30, the motion sensor or activation assembly will detect the motion for automatic, hands-free use of the foot scrubber.

Particularly, upon detecting motion, the cycle is triggered and will begin, in one embodiment, by deactivating the motion sensor, as shown at 206. This will eliminate false triggers or the detection of motion during an active cycle. Furthermore, the cycle will continue by activating the drive assembly for a first predetermined amount of time 208, activating the UV light assembly for a second predetermined amount of time 210, and activating the fluid dispensing assembly for a third predetermined amount of time 212. In one embodiment, the drive assembly 70, UV light assembly 50 and fluid dispensing assembly 60 are all activated simultaneously upon the detection of motion by the motion sensor. However, other embodiments may activate the drive assembly 70, UV light assembly 50 and fluid dispensing assembly 60 at different times or staggered times. For example, the drive assembly 70 may be activated first for a second or more, followed by the UV light assembly 70 and the fluid dispensing assembly 60. Other combinations of start or activation times may vary.

After the first predetermined amount of time, the drive assembly is deactivated 214, after the second predetermined amount of time, the UV light assembly 50 is deactivated 216, and after the third predetermined amount of time, the fluid dispensing assembly 60 is deactivated 218. For purposes of this disclosure, the terms "first predetermined amount of time," "second predetermined amount of time," and "third predetermined amount of time" do not indicate the lengths or order of activation or deactivation. Rather, "first," "second," and "third," are merely provided as distinguishing terms not meant to limit or define the amount of time, or order of activation or deactivation.

For example, in at least one embodiment, the first and second predetermined amounts of time may be equal to one another in that, if the drive assembly and the UV light assembly are activated simultaneously, they will automatically deactivate simultaneously. Further, the third predetermined amount of time may be less than both the first and second predetermined amount of time, meaning that if the fluid dispensing assembly is also activated simultaneously with the drive assembly and the UV light assembly, the fluid dispensing assembly will deactivate first. Upon deactivation of the drive assembly, UV light assembly and fluid dispensing assembly, the motion detector may be reactivated 220 to end the cycle.

It should be noted that the activation assembly 110 in combination with the control assembly or PCB 104 function to automatically activate and deactivate the various components, including the drive assembly 70, the UV light assembly 50 and the fluid dispensing assembly 60, in accordance with the present invention and in order to define a full cycle. For illustrative purposes, a cycle is defined as beginning when motion is detected via the activation assembly, and ending when all of the components (e.g., the drive assembly 70, UV light assembly 50 and fluid dispensing assembly 60) are activated then deactivated, and, in certain embodiments, the activation assembly reactivated. Furthermore, within the scope of the present invention, a cycle in certain implemented embodiments may include activation and deactivation of only some of the components (e.g., only the drive assembly and the UV light assembly, or only the drive assembly and the fluid dispensing assembly) and not others.

Figure 13:
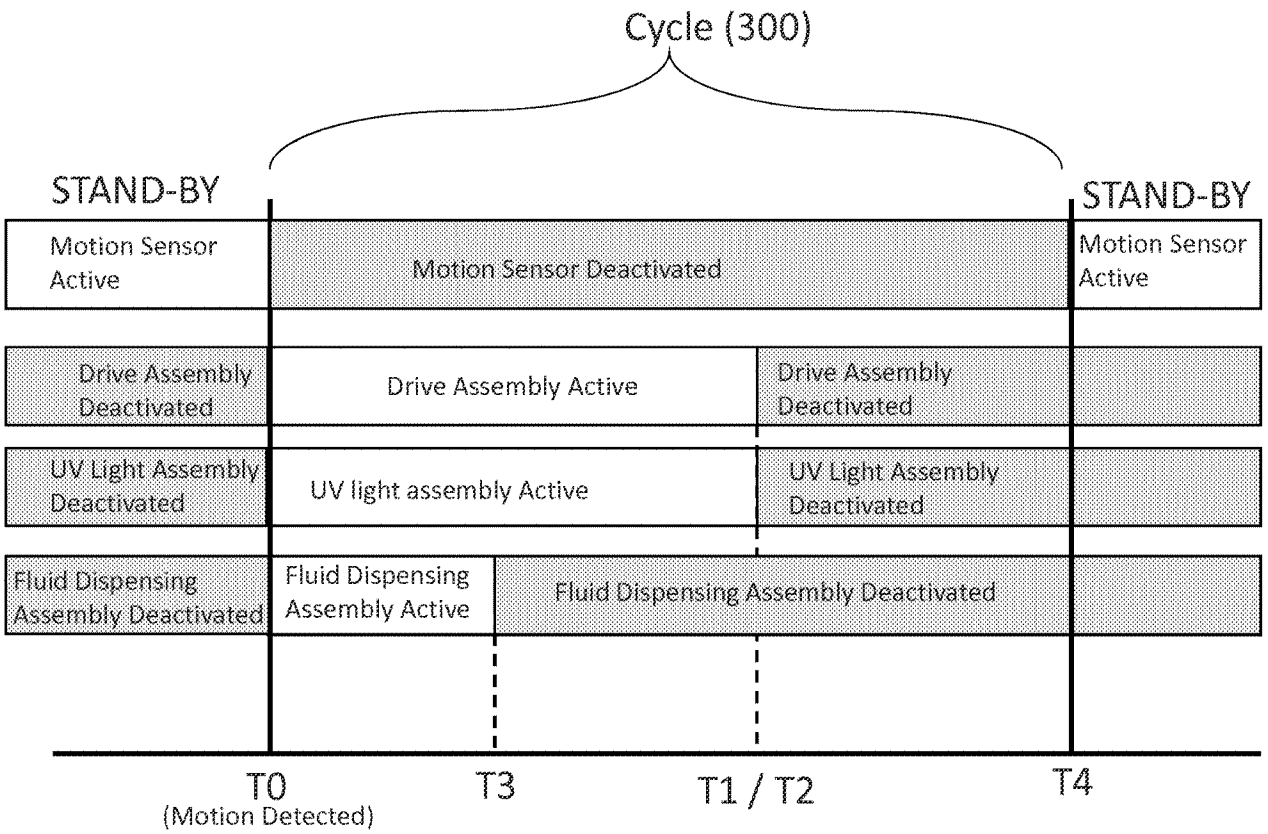
FIG. 13 is an exemplary timeline of a cycle as disclosed in accordance with at least one embodiment of the present invention.

FIG. 13 is provided as an illustrative timeline (not drawn to scale) of a cycle 300 as disclosed in at least one embodiment of the present invention. For instance, when the foot scrubber is in "Stand-By" mode, the activation assembly or motion sensor 110 is active and waiting to detect motion. While in "Stand-By," the drive assembly 70, UV light assembly 50 and fluid dispensing assembly 60 are deactivated. Upon detection of motion, for instance at T0 in FIG. 13, a cycle 300 begins and the drive assembly 70, UV light assembly 50 and fluid dispensing assembly 60 are activated. This will, thus, rotate the brush assembly 20, illuminate the UV light assembly 50 and pump fluid from the reservoir through the nozzles and into the scrubbing region 30. After a predetermined amount of time, represented at T3, the fluid dispensing assembly may be deactivated. Thus, after T3, the brush assembly 20 may remain active and the UV light assembly may remain illuminated. In the embodiment illustrated, both the drive assembly 70 and the UV light assembly 50 are deactivated simultaneously, for example, at T1/T2. In this manner, the drive assembly, UV light assembly and fluid dispensing assembly are all deactivated for the remainder of the cycle. This allows the scrubber to drain, recalibrate, and prepare for a new cycle. At T4, the motion sensor is activated and the foot scrubber return to "Stand-By," where motion is again prepared to be detected.

As just an example, the first and second predetermined amount of time (T1 and T2), as used herein to describe the amount of time the drive assembly and the UV light assembly are active may be about 5 or 6 seconds. The third predetermined amount of time (T3), as used herein to describe the amount of time the fluid dispensing assembly is active, may be about 1.5 seconds. The entire cycle, referenced at T4 in FIG. 13, may be about 12 seconds. However, other times may be implemented.

Furthermore, as provided herein, at least one embodiment of the present invention includes indicator lights 106 disposed on the external portion of the housing 12 and used to indicate to the user the progress of the cycle 300. For example, in one embodiment, there may be three (3) indicate lights to denote Stand-By mode, Active Cycle mode, and Transition mode. Particularly, the Stand-By indicator light may illuminate when the foot scrubber is in the "Stand-By" mode, i.e., when the motion detector is active and waiting for motion to automatically begin the next cycle. When the cycle begins, the Stand-By light may turn off, and the Active Cycle indicator light may illuminate indicating that the cycle is active and for the user to keep his or her foot on the brush assembly. When the drive assembly, UV light assembly and fluid dispensing assembly are all deactivated, the Active Cycle indicator light may turn off, and a Transition Light may illuminate for the remainder of the cycle and until the foot scrubber again enters the Stand-By mode.

It should also be noted that the above described cycle 300 and indicator lights are provided for exemplary and illustrative purposes only and other combinations and cycles may be implemented within the full spirit and scope of the present invention, including additional or different sequences, timing, etc.

This written description provides an illustrative explanation and/or account of the present invention. It may be possible to deliver equivalent benefits and insights using variations of the sequence, steps, specific embodiments and methods, without departing from the inventive concept. This description and these drawings, therefore, are to be regarded as illustrative and not restrictive.

Now that the invention has been described,

What is claimed is:

1. A foot scrubber, comprising:

a housing, wherein said housing comprises a scrubbing region and an internal region, said scrubbing region defined by oppositely disposed side walls, a rear wall, an at least partially open front portion and a bottom surface, said bottom surface comprising an at least partially sloped configuration from said rear wall down toward said at least partially open front portion, a brush assembly disposed within said scrubbing region of said housing, said brush assembly comprising a plurality of elongated rotational brushes for scrubbing a foot of a user, each of said plurality of elongated rotational brushes comprising oppositely disposed connection ends removably engaged with cooperatively structured and rotationally disposed drive ends positioned on said oppositely disposed side walls of said scrubbing region of said housing, wherein each of said plurality of elongated brushes comprise an at least partially flexible axle for facilitating a removable engagement between said at least one brush and said drive ends, a drive assembly disposed at least partially within said internal region of said housing and in a driving relation with said brush assembly, said drive assembly being structured to rotationally drive said brush assembly about at least one axis, a fluid dispensing assembly connected to said housing and positioned to dispense a fluid into said scrubbing region for contact with the foot, wherein said fluid dispensing assembly further comprises a reservoir for at least temporarily retaining said fluid therein, and at least one pump and at least one nozzle fluidically disposed with said reservoir for dispensing said fluid into said scrubbing region of said housing, at least one ultraviolet (UV) light assembly disposed in an illuminating relation with said scrubbing region of said housing, an activation assembly comprising at least one motion sensor for automatically activating said drive assembly, said at least one ultraviolet (UV) light assembly and said fluid dispensing assembly according to a predetermined cycle, said predetermined cycle comprising activation of said drive assembly, said at least one ultraviolet (UV) light assembly and said fluid dispensing assembly for predetermined amounts of time.

* * * * *